US008522963B2

(12) United States Patent
Chiappini

(10) Patent No.: US 8,522,963 B2
(45) Date of Patent: Sep. 3, 2013

(54) CASE FOR HOUSING AND CONTAINER FOR ELONGATED OBJECTS

(75) Inventor: Andrea Chiappini, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 29 days.

(21) Appl. No.: 13/166,555

(22) Filed: Jun. 22, 2011

(65) Prior Publication Data

US 2011/0315565 A1 Dec. 29, 2011

(30) Foreign Application Priority Data

Jun. 23, 2010 (IT) ..... TO2010A0541

(51) Int. Cl.
*F42B 39/22* (2006.01)

(52) U.S. Cl.
USPC ..... 206/3; 89/34

(58) Field of Classification Search
CPC ..... F42B 39/22; F42B 39/00
USPC ..... 206/3, 477, 480, 483; 89/34, 46
See application file for complete search history.

(56) References Cited

U.S. PATENT DOCUMENTS 2,432,802 A * 12/1947 Reynolds ..... 211/60.1
4,125,052 A 11/1978 Thomas
4,487,104 A * 12/1984 Schiele et al. ..... 89/34
4,598,623 A 7/1986 Hersemeyer et al.
5,175,388 A * 12/1992 Maher et al. ..... 89/35.01
2002/0134693 A1 * 9/2002 Boutet et al. ..... 206/3

FOREIGN PATENT DOCUMENTS

DE 25 01 425 7/1975
GB 1 492 815 11/1977

OTHER PUBLICATIONS

Italian Search Report for Application No. TO20100541 mailed Feb. 18, 2011.

* cited by examiner

*Primary Examiner* — David Fidei
(74) *Attorney, Agent, or Firm* — Merchant & Gould P.C.

(57) ABSTRACT

A case for housing elongated objects includes a box body (2), having a size such that the box body can adequately contain the elongated object (O), which is inserted in the body through a front opening (21). The case has a lock the object housed in the case including at least a movable plate (23) arranged along at least a border (24) of the opening (21), movable between an open position wherein the plate impedes the passage from the inside to the outside of the case to the object to be kept and a closed position wherein the plate substantially arranges along at least a side (25) of the box body, in such a way as not to substantially obstruct the opening.

5 Claims, 2 Drawing Sheets

CASE FOR HOUSING AND CONTAINER FOR ELONGATED OBJECTS

This application claims benefit of Serial No. TO 2010 A 000541, filed 23 Jun. 2010 in Italy and which application is incorporated herein by reference. To the extent appropriate, a claim of priority is made to the above disclosed application.

BACKGROUND

The present invention relates to a case for housing and container for elongated objects. Such cases are normally arranged, in a tidy way, in a warehouse or a store.

In particular, the present invention relates to elongated objects, such as for example bullets that may be seated within such cases that must be provided to a magazine of firearms. Such magazine may be a magazine for firearms placed on military means, or in fixed stations; whereas the cases with the bullets may be seated in a warehouse or a store, comparable to a store underneath the firearm, such as the hold of a ship.

In such technical solutions, the ammunition or bullet must be quickly brought from the ship's hold, or in general from the ammunition warehouse or store towards the magazine, which must always contain at least a sufficient predetermined number of bullets. Therefore, in a warehouse or store, the accessibility to the ammunition by an automatic handling device capable of picking up the objects, or by an operator intended for performing such function in a manual manner, is a relatively important parameter for the efficiency of the entire loading system of the firearm and for the efficiency of the store management in general.

Thus, a very important parameter for the efficiency of an entire handling system for objects contained in cases in a warehouse, is the speed at which such system determines the object availability. From this point of view, the time required for removing the objects from the cases containing them is also important.

Prior art solutions do not provide efficient solutions to these problems. The Applicant therefore proposes a case having such features as to obviate such problems.

SUMMARY

In particular, the present invention relates to a case for housing and container for elongated objects.

In an embodiment of the invention, such objects are bullets contained in cases stored in a warehouse, which must be made available to a magazine of firearms associated to such warehouse. The cases are arranged in the warehouse according to at least one supply module formed by a plurality of rows of cases.

BRIEF DESCRIPTION OF THE DRAWINGS

The features and the advantages of such case shall appear more clearly from the following description of an embodiment with reference to the annexed figures, which schematically show.

DETAILED DESCRIPTION

Figure 1:
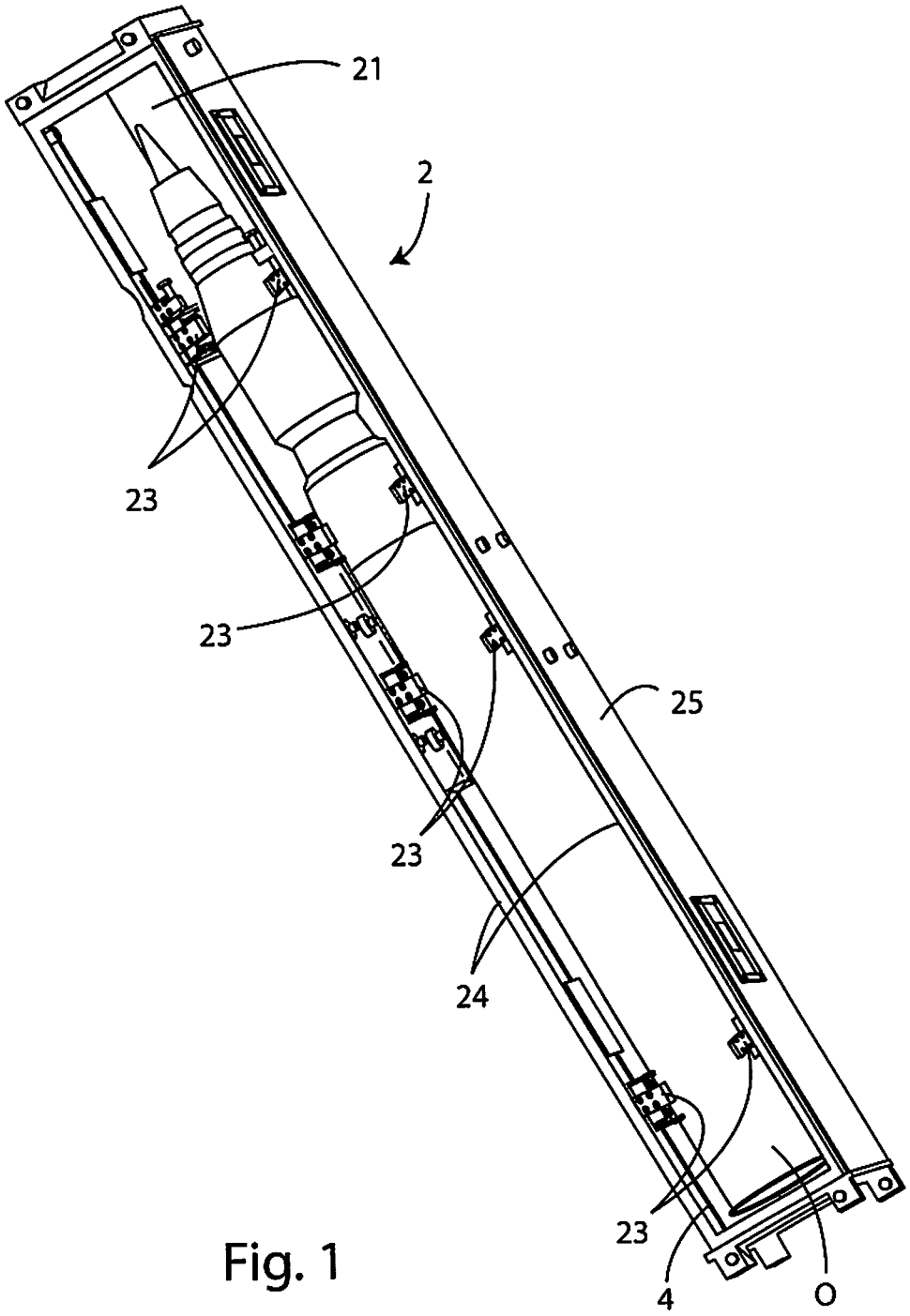
FIG. 1 a schematic perspective view of the case as a whole according to the present invention.
Figure 2:
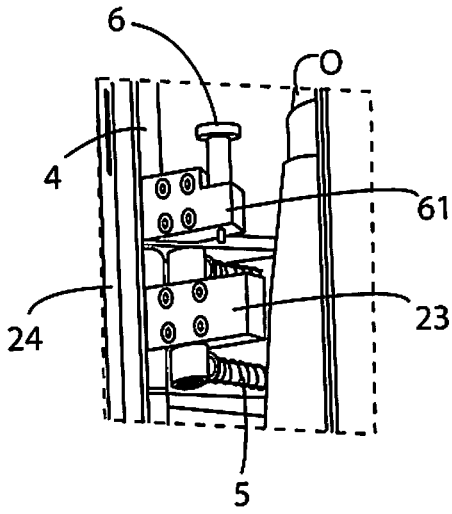
FIGS. 2 and 3 show respective details of the mechanism for retaining the elongated object contained in the case.
Figure 3:
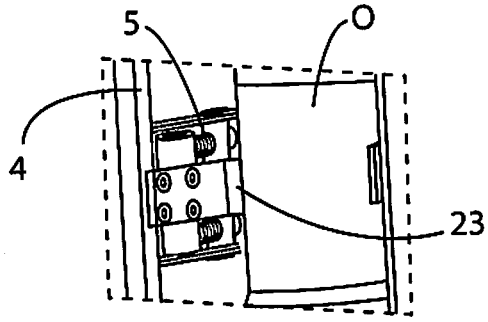

With reference to said figures, the case for housing or container for elongated objects O, comprises a box body 2, having a size such that it can adequately contain the elongated object, which may be inserted in such body through a front opening 21. Such opening may be closed through a conventional closing port (not shown) provided with steady closing means, such as a rotating lever.

The case comprises means for locking the object that may be housed in the case itself comprising at least a movable plate 23 arranged along at least a border 24 of such opening 21, such plate being movable between an open position wherein it impedes the passage from the inside to the outside of the case and vice versa to the object to be kept and a closed position wherein it substantially arranges along at least a side 25 of the box body, in such a way as not to substantially obstruct said opening.

Preferably, such at least one plate in closed position arranges in parallel to sides 25 of the box body. In the embodiment shown, such locking means comprise a plurality of plates arranged along both the longitudinal borders of the case opening. Such plates are capable of rotating around an axis substantially parallel to such longitudinal borders, so as to arrange in open position orthogonally to the side at the opening and in closed position along the side and within the box body.

The rotation of the plates is allowed by the presence of a driving shaft 4 arranged along each longitudinal border 24 of the opening and to which are fixed such plates.

Elastic counter elements determine the keeping of plates in the open position, in absence of external stresses.

Such elastic means contrast the rotation of the plates inwards of the case, due for example to the thrust of an object that must be inserted in the case itself. In fact, the insertion of an object in the case can advantageously be made directly by pushing it inwards by making it leaning on the plates and exerting on them a thrust such that to win the counteraction of elastic means.

As an alternative, the plates may be made rotating acting on the driving shaft or thrusting the plates with other suitable thrusting means. The elastic means preferably comprise a pair of springs 5 that are compressed when the plates are made to rotate inwards of the case. Advantageously, according to the present invention, the case also comprises means for retaining the plates in the closed position, so as to facilitate the operation of removing the object from the case since the plates cannot rotate inwards of the case itself beyond said open position. Thus, in order to allow the object removal they must be kept closed for a predetermined time and this can advantageously be carried out through such retaining means, which in the embodiment shown comprise a pin 6 supported by a bracket 61 constrained to the case, which inserts in a housing obtained on such plates.

Advantageously, if there is more than one plate per opening side of the case, the retaining means are only associated to one plate per side, preferably that arranged in the centremost position of the opening, so as to limit the stresses on the driving shaft.

With the present invention, access to the object stored in the case is relatively simple, since once the cover has been opened for accessing the object itself it is sufficient to move the plates to the closed position by simply exerting a thrust from the exterior; the object is then easily removed. Advantageously, during the removal the retaining means keep the plates in such closed position for the time required. As simplified is the operation of inserting the object in the case, which can take place by simply "pushing" the object inside with such a force as to overcome the resistance of the elastic means associated to the plates, moving them from the open position to the closed one.

The invention claimed is:

1. A case for housing and container for elongated objects comprising a box body, having a size that can adequately contain the elongated object, which is inserted in said body through a front opening, comprising:

means for locking the object housed in the case comprising at least a movable plate arranged along at least a border of said opening, movable between an open position wherein the movable plate impedes the passage from the inside to the outside of the case to the object to be kept and a closed position wherein the movable plate is substantially arranged along at least a side of the box body, in such a way as not to substantially obstruct said opening;

insertion of the object in the case is made by pushing said object inwards by making said object lean on the plates and exerting on the plates a thrust to counteract elastic counter elements;

said elastic counter elements determine keeping of plates in the open position, in absence of external stresses, contrasting with rotation of plates toward the inside of the case;

said case comprising retaining means for retaining the plates in a closed position; said retaining means comprising a pin supported by a bracket constrained to the case, which inserts in a housing defined by said plates.

2. The case according to claim 1, wherein said at least one plate in closed position is arranged in parallel to sides of the box body.

3. The case according to claim 1, wherein said locking means comprises a plurality of said plates arranged along both the longitudinal borders of the case opening, able to rotate around an axis substantially parallel with respect to said longitudinal borders, to arrange in an open position orthogonally with respect to the side of the opening and in a closed position along the side and inside the box body.

4. The case according to claim 3, wherein the rotation of the plates is determined by a driving shaft arranged along each longitudinal border of the opening and to which are fixed said plates.

5. The case according to claim 4, wherein plates are made rotating acting on the driving shaft or thrusting the plates with other suitable thrusting means.

* * * * *